US006971300B2

(12) United States Patent
Kunstmann

(10) Patent No.: US 6,971,300 B2
(45) Date of Patent: Dec. 6, 2005

(54) RELOADABLE CONCENTRIC CANISTER LAUNCHER

(75) Inventor: John F. Kunstmann, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 62 days.

(21) Appl. No.: 10/722,210

(22) Filed: Nov. 25, 2003

(65) Prior Publication Data

US 2005/0108917 A1 May 26, 2005

(51) Int. Cl.[7] ..... F41F 3/04; F41A 3/04
(52) U.S. Cl. ..... 89/1.816; 89/20.2
(58) Field of Search ..... 89/1.8, 1.815, 89/1.816, 1.819, 17, 18, 19, 20.2

(56) References Cited

U.S. PATENT DOCUMENTS 3,499,364 A * 3/1970 Ooge ..... 89/1.81
4,173,919 A * 11/1979 Piesik ..... 89/1.8
4,646,618 A * 3/1987 Kurth et al. ..... 89/1.816
4,686,884 A * 8/1987 Piesik ..... 89/1.816
4,934,241 A * 6/1990 Piesik ..... 89/1.817
5,012,718 A * 5/1991 Miller ..... 89/1.816
5,194,688 A * 3/1993 Piesik ..... 89/1.816
5,617,665 A 4/1997 Hoenig ..... 42/8
5,679,917 A * 10/1997 Bitsakis et al. ..... 89/20.2
5,837,919 A * 11/1998 Yagla et al. ..... 89/1.816
6,079,310 A * 6/2000 Yagla et al. ..... 89/1.816
6,230,604 B1 * 5/2001 Larson et al. ..... 89/1.817
6,526,860 B2 * 3/2003 Facciano et al. ..... 89/1.801
6,584,882 B2 * 7/2003 Briggs et al. ..... 89/1.817

* cited by examiner

*Primary Examiner*—Michael J. Carone
*Assistant Examiner*—Bret Hayes
(74) *Attorney, Agent, or Firm*—Matthew J. Bussan, Esq.; Scott R. Boalick, Esq.

(57) ABSTRACT

A reloadable launcher for use with rocket-propelled projectiles. An inner and outer tube define a concentric tube arrangement with at least one gas flow channel being defined therebetween. A ring is fixedly coupled to a first end of the outer tube that is adjacent to the breech end of the inner tube. The ring defines a keyway and an annular channel that lies between the keyway and the first end of the outer tube. A cap having a concave inner surface terminates in a peripheral edge that defines a key shaped for passage through the keyway of the ring. When the cap's key is aligned with and moved axially through the keyway, the key resides in the annular channel adjacent the first end of the outer tube. A link is hingedly coupled on one end thereof to the ring to permit the cap to be moved such that a projectile can be loaded into the inner tube from the breech end thereof. The link is also rotationally coupled to the cap's central portion such that the cap can be rotated thereabout. As a result, when the key resides in the annular channel and the cap is rotated about it's central portion, the key is misaligned with the keyway to axially lock the cap to the outer tube.

11 Claims, 2 Drawing Sheets

10
12
12A
13
14
14A
16
18
20
22
24
26
30
30A
30B
32
40
42
44
46
48
100
102
2
3

20
22
24
26

30
32

RELOADABLE CONCENTRIC CANISTER LAUNCHER

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to launchers, and more particularly to a reloadable launcher for use with rocket-propelled projectiles.

BACKGROUND OF THE INVENTION

The launching of a small rocket-propelled projectile is accomplished using a concentric canister launcher such as the one disclosed by Yagla et al. in U.S. Pat. No. 5,837,919. Briefly, this type of launcher has concentrically aligned inner and outer tubes with a concentric gas flow duct defined between the two tubes. Rocket exhaust gases flow out of the inner tube and are re-directed towards the gas flow duct by a cap that is welded to the outer tube. This type of launcher is typically incorporated into a close-pack arrangements or arrays of such launchers. Loading of each tube takes place in a depot before being sent out into the field. Thus, this type of launcher is a single-fire device that must be recycled to the depot before being used again.

Naturally, it would be desirable to re-load a concentric canister launcher in the field. Ideally, this is accomplished by having the concentric canister launcher open at both the muzzle and breech ends thereof to facilitate positioning of a projectile therein as well as facilitating the connection of control cables to the projectile. Thus, a concentric canister launcher's breech end must be able to be opened/closed. Further, since these types of launchers are generally found in close pack arrangements of multiple launchers, the breech end open/close system cannot encumber adjacent launchers.

While a variety of breech end open/closing systems are known in the art, none are suitable for use with a concentric canister launcher. For example, U.S. Pat. No. 5,679,917 discloses a breech plug support mechanism in which a movable ring is rotationally coupled to the breech end of launch tube. A plug is locked into place by moving the ring by means of a radially extending handle. The plug is moved into/out of axial alignment with the launch tube by means of a rod that is slidingly supported by brackets mounted along the launch tube. However, this type of system could not be used for tubes in a close pack arrangement as the operational mechanisms would be encumbered by adjacent launch tubes.

SUMMARY OF THE INVENTION

Accordingly, it is an object of the present invention to provide a reloadable launcher for use with rocket-propelled projectile.

Another object of the present invention is to provide a reloadable concentric canister launcher.

Other objects and advantages of the present invention will become more obvious hereinafter in the specification and drawings.

In accordance with the present invention, a reloadable launcher for use with rocket-propelled projectiles has an inner tube and an outer tube fixedly coupled to one another to define a concentric tube arrangement with at least one gas flow channel being defined therebetween. The inner tube is capable of supporting a launch of a rocket-propelled projectile therefrom wherein gases produced during the launch are directed toward and escape from a breech end of the inner tube while the projectile is propelled towards a muzzle end of the inner tube. A ring is fixedly coupled to a first end of the outer tube that is adjacent to the breech end of the inner tube. The ring defines a keyway and an annular channel that lies between the keyway and the first end of the outer tube. A cap having a concave inner surface terminates in a peripheral edge that defines a key shaped for passage through the keyway of the ring. The cap is sized/shaped such that, when the cap's concave inner surface faces the breech end of the inner tube and the key is aligned with and moved axially through the keyway, the key resides in the annular channel adjacent the first end of the outer tube with the cap's central portion thereof aligned with a central longitudinal axis of the inner tube. A link is hingedly coupled on one end thereof to the ring to permit the cap to be moved such that a projectile can be loaded into the inner tube from the breech end thereof. The link is also rotationally coupled to the cap's central portion such that the cap can be rotated about the central portion. As a result, when the key resides in the annular channel and the cap is rotated about it's central portion, the key is misaligned with the keyway to axially lock the cap to the outer tube.

DETAILED DESCRIPTION OF THE INVENTION

Figure 1:
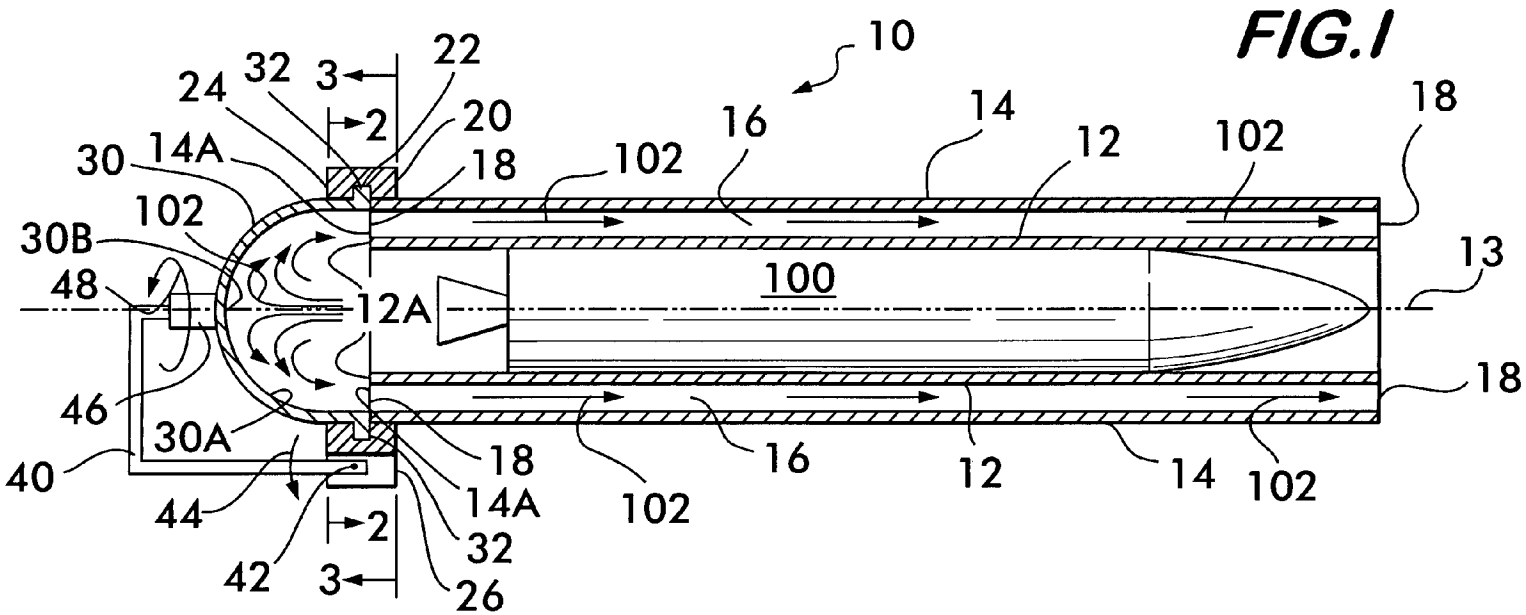
FIG. 1 is a side cross-sectional view of a single reloadable concentric canister launcher in accordance with an embodiment of the present invention.

Referring now to the drawings, and more particularly to FIG. 1, a reloadable launcher in accordance with the present invention is referenced generally by numeral 10. Reloadable launcher 10 is used to launch a rocket-propelled projectile 100, the particular design of which is not a limitation of the present invention. Thus, it is to be understood that the present invention can be adapted for both in-air and underwater usage without departing from the scope thereof.

Reloadable launcher 10 utilizes a concentric canister launch tube arrangement that includes an inner tube 12 and an outer tube 14 rigidly and fixedly coupled to one another such that at least one open-ended gas flow channel 16 is defined therebetween. Typically, a number of gas flow channels 16 are defined at positions surrounding inner tube 12. Gas flow channels 16 can be defined, for example, by the spaces between adjacent longitudinally extending beams (the ends of which are referenced in FIG. 1 by numeral 18)

that are used to couple inner tube 12 to outer tube 14. This type of concentric tube construction is shown and described in detail in U.S. Pat. No. 5,837,919, the contents of which are hereby incorporated by reference.

Figure 2:
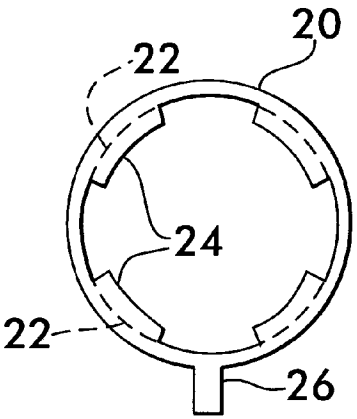
FIG. 2 is an isolated head-on view of the launcher's ring taken along line 2—2 in FIG. 1.

Fixedly coupled to one end 14A (i.e., the breech end) of outer tube 14 is a ring 20 that extends axially aft from outer tube 14. Referring additionally now to the isolated, head-on view of ring 20 shown in FIG. 2, ring 20 defines an annular channel 22 adjacent breech end 14A. More specifically, annular channel 22 is defined by a plurality of projections 24 that extend radially inward. As a result, a keyway is defined by projections 24 in combination with the axial opening of ring 20 as best seen in FIG. 2. Ring 20 also includes a support 26 that extends radially outward from ring 20. Support 26 serves as a point of coupling for a link mechanism as will be explained further below.

In order to make launcher 10 operable, a cap 30 must be placed and held adjacent to breech end 14A when projectile 100 is to be fired therefrom. Briefly, when projectile 100 is fired, exhaust gases 102 exiting the aft end of projectile 100 must be turned or re-directed by cap 30 to flow into gas flow channels 16. Accordingly, cap 30 has a concave inner surface 30A that can be positioned to face and align with outer tube 14. For efficient gas flow, concave inner surface 30A should be contiguous with the inner periphery of outer tube 14 when cap 30 is positioned adjacent to breech end 14A. Note that a sealing gasket (not shown) may be interposed between cap 30 and breech end 14A. The shaping of concave inner surface should be one that efficiently redirects exhaust gases 102. Typically, concave inner surface 30A will be semi-spherical or hemispherical.

Figure 3:
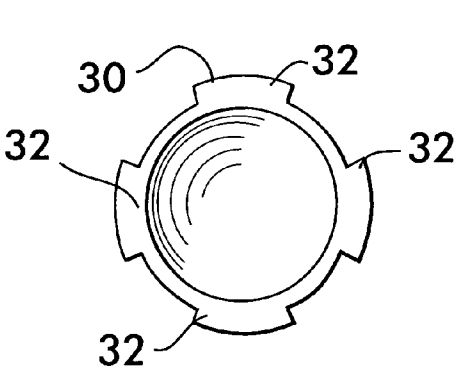
FIG. 3 is an isolated head-on view of the launcher's cap taken along line 3—3 in FIG. 1.

In order for launcher 10 to be reloadable at its breech end thereof, cap 30 must be moved or repositioned to permit access to the breech end 12A of inner tube 12. Referring additionally now to FIG. 3, cap 30 has a plurality of projections 32 that extend radially outward therefrom. Specifically, projections 32 are positioned and sized such that they fit or are "keyed" to fit between projections 24 on ring 20. In other words, the peripheral edge of cap 30 defines a key sized and shaped to fit into the keyway defined by the combination of projections 24 and the axial opening of ring 20. For proper alignment, the central portion 30B of cap 30 should be aligned with the central longitudinal axis 13 of inner tube 12 and outer tube 14. After cap 30 is passed through the keyway defined by ring 20, projections 32 reside in annular channel 22 as best seen in FIG. 1. To lock cap 30 axially relative to outer tube 14, cap 30 must be rotated about axis 13 until at least a portion of projections 32 are aligned with at least a portion of projections 24.

The present invention uses one mechanism for facilitating the locking/unlocking of cap 30 to outer tube 14 as well as the movement of cap 30 away from inner tube 12 and outer tube 14. Specifically, a link arm 40 is hingedly coupled to support 26 at a hinge point 42. Hinge point 42 allows link arm 40 to pivot in one plane as indicated by pivot arrow 44. Link arm 40 is also coupled to cap 30 via a rotational coupling 46 that allows cap 30 to rotate in the rotational plane indicated by rotational arrow 48. Such rotation of cap 30 can be done manually (e.g., by means of a handle mounted on cap 30) or in a mechanized fashion (e.g., by means of a motor coupled to rotational coupling 46) without departing from the scope of the present invention.

In operation, once projectile 100 has been launched, cap 30 is rotated about coupling 46 until projections 32 are aligned with the gaps between projections 24 on ring 20. Cap 30 is then pivoted about hinge point 42 until breech end 12A is accessible. After reloading with another projectile 100, cap 30 is pivoted about hinge point 42 until cap 30 is adjacent breech end 14A. Note that cap 30 may need to be rotated to position projections 32 such that they are aligned with the gaps between projections 24. Once projections 32 reside in annular channel 22, cap 30 is rotated to lock cap 30 adjacent to outer tube 14 as explained above.

Figure 4:
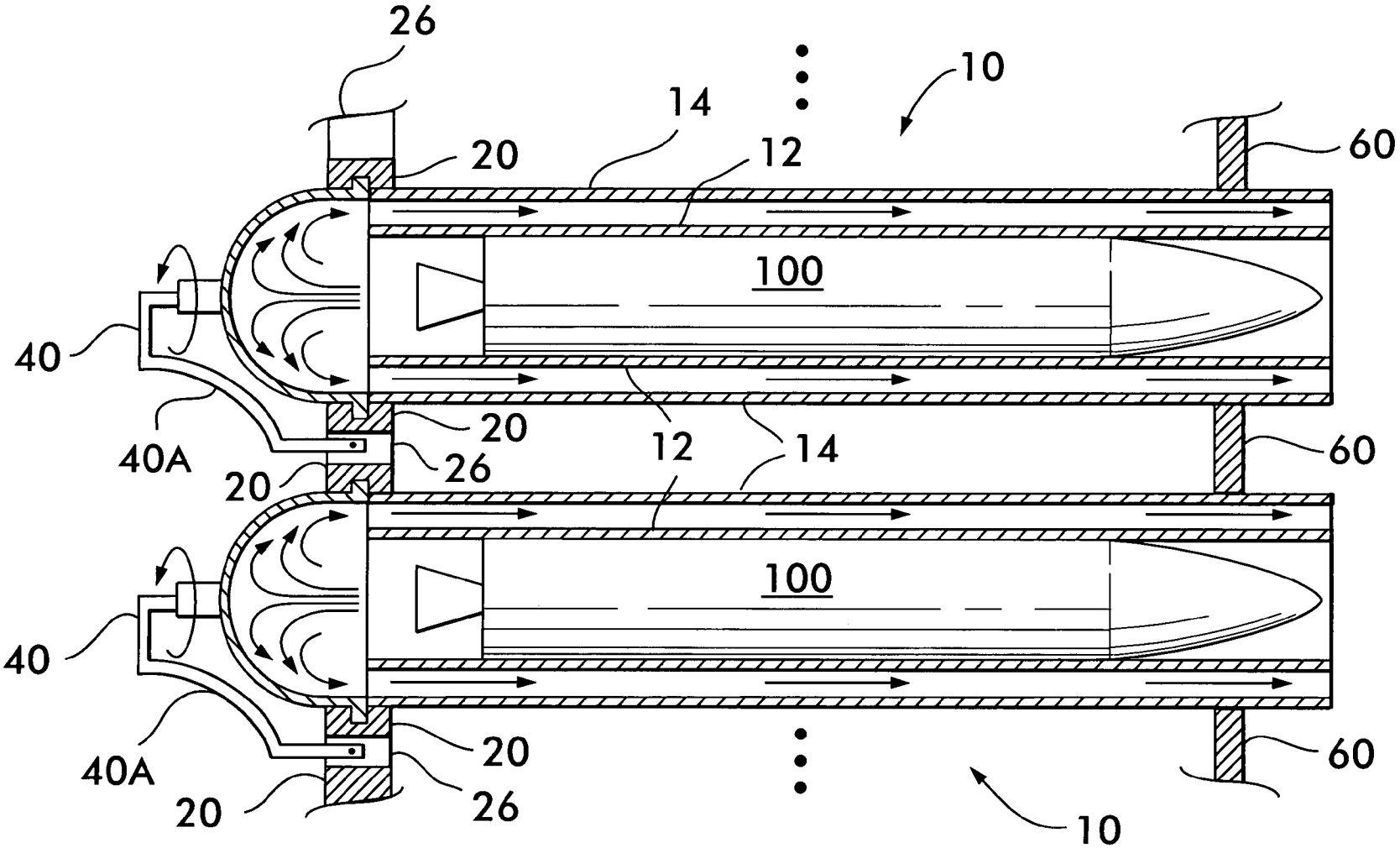
FIG. 4 is a side cross-sectional view of multiple reloadable concentric canister launchers in accordance with the present invention.

The present invention is not limited to use as a single launcher. That is, the present invention is well suited to be used as part of an arrayed arrangement of reloadable launchers. For example, FIG. 4 depicts two of reloadable launchers 10 coupled to one another at their muzzle end by a support plate 60. Additional ones of such launchers could be coupled to plate 60 in a similar fashion. The breech ends of adjacent launchers are coupled together by means of support 26 shared between and coupled to adjacent rings 20 of reloadable launchers 10. In this way, rings 20 provide support for cap 30 and the opening/closing mechanism therefore, as well as providing a structural breech end support between adjacent launchers. Note that link arm 40 can be shaped at 40A to accommodate the shape of cap 30 of an adjacent launcher when link arm 40 is pivoted away from its outer tube 14.

Figure 5:
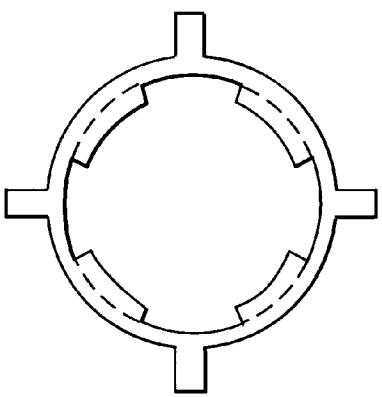
FIG. 5 is an isolated head-on view of another embodiment of the launcher's ring for use in an arrayed arrangement of reloadable launchers.

Each ring 20 can have one or more supports 26 depending therefrom depending on how many reloadable launchers are to be arrayed thereabout. For example, as shown in FIG. 5, ring 20 could have multiple supports 26 depending/extending radially out therefrom to permit the coupling of adjacent reloadable launchers thereabout.

The advantages of the present invention are numerous. The reloadable launcher will allow multiple propelled projectiles to be fired from the same launcher without the need to return the launcher to a depot. Furthermore, the breech opening/closing system is ideally suited for incorporation into an array of reloadable launchers.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

What is claimed is:

1. A reloadable launcher for use with rocket-propelled projectiles, comprising:

an inner tube and an outer tube fixedly coupled to one another to define a concentric tube arrangement with at least one gas flow channel being defined therebetween, said inner tube supporting a launch of a rocket-propelled projectile therefrom wherein gases produced during the launch are directed toward and escape from a breech end of said inner tube while the projectile is propelled towards a muzzle end of said inner tube;

a ring fixedly coupled to a first end of said outer tube that is adjacent to said breech end of said inner tube, said ring defining a keyway and an annular channel between said keyway and said first end of said outer tube;

a cap having a concave inner surface, said cap terminating in a peripheral edge that defines a key shaped for passage through said keyway of said ring wherein, when said concave inner surface faces said breech end and said key is aligned with and moved axially through said keyway, said key resides in said annular channel adjacent said first end of said outer tube, said cap further having a central portion thereof that is aligned with a central longitudinal axis of said inner tube when said key resides in said annular channel; and a link hingedly coupled on one end thereof to said ring to permit said cap to be moved such that the projectile can be loaded into said inner tube from said breech end thereof, said link further being rotationally coupled to said cap at said central portion thereof such that said cap can be rotated about said central portion wherein, when said key resides in said annular channel and said cap is rotated about said central portion, said key is misaligned with said keyway wherein said cap is axially locked to said outer tube.

2. A reloadable launcher as in claim 1 wherein said keyway is defined by a plurality of spaced apart radially extending slots and said key is defined by a corresponding plurality of spaced apart radially extending projections sized and shaped for passage through said plurality of spaced apart radially extending slots.

3. A reloadable launcher as in claim 1 wherein an inner periphery of said outer tube at said first end thereof aligns with said cap when said key resides in said annular channel such that said inner periphery is contiguous with said concave inner surface of said cap.

4. A reloadable launcher as in claim 1 wherein said concave inner surface of said cap is semi-spherical.

5. A reloadable launcher as in claim 1 wherein said concave inner surface of said cap is hemispherical.

6. A reloadable launcher for use with rocket-propelled projectiles, comprising:

a concentric canister launch tube arrangement having an inner tube fixedly coupled to an outer tube with open-ended gas flow ducts being defined therebetween and along the length thereof, said inner tube supporting a launch of a rocket-propelled projectile therefrom wherein gases produced during the launch are directed toward and escape from a breech end of said inner tube while the projectile is propelled towards a muzzle end of said inner tube;

a ring fixedly coupled to a first end of said outer tube that is aligned with said breech end of said inner tube, said ring extending axially from said outer tube, said ring defining a keyway and an annular channel between said keyway and said first end of said outer tube;

a hemispherical cap terminating in a peripheral edge that defines a key shaped for passage through said keyway of said ring wherein, when said key is aligned with and moved axially through said keyway, said key resides in said annular channel adjacent said first end of said outer tube; and means for coupling said hemispherical cap to said ring to permit said hemispherical cap to be (i) moved such that the projectile can be loaded into said inner tube from said breech end thereof, and (ii) rotated when said key resides in said annular channel to misalign said key and said keyway thereby axially locking said hemispherical cap to said outer tube, wherein said gases produced by the launch are re-directed by said hemispherical cap towards said open-ended gas flow ducts.

7. A reloadable launcher as in claim 6 wherein said keyway is defined by a plurality of spaced apart radially extending slots and said key is defined by a corresponding plurality of spaced apart radially extending projections sized and shaped for passage through said plurality of spaced apart radially extending slots.

8. A reloadable launcher as in claim 6 wherein an inner periphery of said outer tube at said first end thereof aligns with said hemispherical cap when said key resides in said annular channel such that said inner periphery is contiguous with said hemispherical cap.

9. A reloadable launcher for use in an arrayed arrangement of reloadable launchers where each said reloadable launcher fires a rocket-propelled projectile therefrom, each said reloadable launcher comprising:

a concentric canister launch tube arrangement having an inner tube fixedly coupled to an outer tube with open-ended gas flow ducts being defined therebetween and along the length thereof, said inner tube supporting a launch of the rocket-propelled projectile therefrom wherein gases produced during the launch are directed toward and escape from a breech end of said inner tube while the projectile is propelled towards a muzzle end of said inner tube;

a ring fixedly coupled to a first end of said outer tube that is aligned with said breech end of said inner tube, said ring extending axially from said outer tube, said ring having a keyway and an annular channel between said keyway and said first end of said outer tube, said ring further defining at least one support extending radially outward therefrom wherein said at least one support can be used as a point of coupling to another ring associated with an adjacent one of the reloadable launchers in the arrayed arrangement thereof;

a hemispherical cap terminating in a peripheral edge that defines a key shaped for passage through said keyway of said ring wherein, when said key is aligned with and moved axially through said keyway, said key resides in said annular channel adjacent said first end of said outer tube; and means for coupling said hemispherical cap to said ring to permit said hemispherical cap to be (i) moved such that the projectile can be loaded into said inner tube from said breech end thereof, and (ii) rotated when said key resides in said annular channel to misalign said key and said keyway thereby axially locking said hemispherical cap to said outer tube, wherein said gases produced by the launch are re-directed by said hemispherical cap towards said open-ended gas flow ducts.

10. A reloadable launcher as in claim 9 wherein said keyway is defined by a plurality of spaced apart radially extending slots and said key is defined by a corresponding plurality of spaced apart radially extending projections sized and shaped for passage through said plurality of spaced apart radially extending slots.

11. A reloadable launcher as in claim 9 wherein an inner periphery of said outer tube at said first end thereof aligns with said hemispherical cap when said key resides in said annular channel such that said inner periphery is contiguous with said hemispherical cap.

* * * * *